US011840914B1

(12) United States Patent
Mao et al.

(10) Patent No.: US 11,840,914 B1
(45) Date of Patent: Dec. 12, 2023

(54) MULTI-STAGE PERFORATION AND SHOCK WAVE COMBINED DEVICE AND METHOD FOR INITIAL FRACTURE ENHANCEMENT

(71) Applicant: INSTITUTE OF GEOLOGY AND GEOPHYSICS, CHINESE ACADEMY OF SCIENCES, Beijing (CN)

(72) Inventors: Tianqiao Mao, Beijing (CN); Xiao Li, Beijing (CN); Guanfang Li, Beijing (CN); Shouding Li, Beijing (CN); Yanzhi Hu, Beijing (CN); Bo Zheng, Beijing (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 18/228,739

(22) Filed: Aug. 1, 2023

(30) Foreign Application Priority Data

Sep. 1, 2022 (CN) ..... 202211059695.1

(51) Int. Cl.

| | |
|---|---|
| ***E21B 43/263*** | (2006.01) |
| ***E21B 43/116*** | (2006.01) |
| *E21B 23/08* | (2006.01) |
| *E21B 47/09* | (2012.01) |

(52) U.S. Cl.
CPC ..... *E21B 43/263* (2013.01); *E21B 43/116* (2013.01); *E21B 23/08* (2013.01); *E21B 47/09* (2013.01)

(58) Field of Classification Search
CPC ..... E21B 43/116; E21B 43/263; E21B 23/08; E21B 47/09
See application file for complete search history.

(56) References Cited

U.S. PATENT DOCUMENTS 3,422,760 A * 1/1969 Mohaupt ..... E21B 43/263 102/326
9,995,124 B2 * 6/2018 Moore ..... F42B 3/04
(Continued)

FOREIGN PATENT DOCUMENTS

CN 200978656 Y 11/2007
CN 203847080 U 9/2014
(Continued)

*Primary Examiner* — Christopher J Sebesta
(74) *Attorney, Agent, or Firm* — Bayramoglu Law Offices LLC

(57) ABSTRACT

A multi-stage perforation and shock wave combined device and method for initial fracture enhancement are provided. The multi-stage perforation and shock wave combined device for initial fracture enhancement includes a perforating gun and a shock wave excitation nipple, where the perforating gun is configured to fire perforating bullets into a formation to form initial fractures; the shock wave excitation nipple is connected to the perforating gun, and includes an energetic rod capable of exploding after excitation and a feeding assembly; the feeding assembly includes a pushing head, a reciprocating spring, and a feeding spring; and the reciprocating spring is configured to push the pushing head, so as to push a spare energetic rod into a target position.

8 Claims, 9 Drawing Sheets

(56) References Cited

U.S. PATENT DOCUMENTS

| | | | | |
|---|---|---|---|---|
| 2009/0301721 | A1* | 12/2009 | Barykin | E21B 43/003 166/299 |
| 2012/0067583 | A1 | 3/2012 | Zimmerman et al. | |
| 2013/0161007 | A1* | 6/2013 | Wolfe | E21B 43/11857 166/63 |

FOREIGN PATENT DOCUMENTS

| | | | |
|---|---|---|---|
| CN | 109915080 | A | 6/2019 |
| CN | 112378790 | A | 2/2021 |
| CN | 112483000 | A | 3/2021 |
| CN | 113882858 | A | 1/2022 |
| CN | 115126452 | A | 9/2022 |
| JP | H07277280 | A | 10/1995 |
| WO | 2017179072 | A1 | 10/2017 |
| WO | 2018060800 | A1 | 4/2018 |

* cited by examiner

B-B

MULTI-STAGE PERFORATION AND SHOCK WAVE COMBINED DEVICE AND METHOD FOR INITIAL FRACTURE ENHANCEMENT

CROSS REFERENCE TO THE RELATED APPLICATIONS

This application is based upon and claims priority to Chinese Patent Application No. 202211059695.1, filed on Sep. 1, 2022, the entire contents of which are incorporated herein by reference.

TECHNICAL FIELD

The present disclosure relates to the technical field of oil and gas extraction, and in particular to a multi-stage perforation and shock wave combined device and method for initial fracture enhancement.

BACKGROUND

A major breakthrough in the core technology of horizontal drilling and hydro-fracturing has triggered a revolution in the global unconventional tight oil and gas, and changed the world energy resources pattern. As an important means of increasing oil and gas well production, horizontal well development features a large seepage area and high sweep efficiency. In order to further realize effective exploitation and maximize the potential of horizontal wells, multi-stage perforations are often carried out in actual horizontal well development to achieve effective multi-stage hydro-fracturing. The multi-stage hydro-fracturing of horizontal wells has become an important way to improve the comprehensive benefits of oil and gas field development.

The unconventional oil and gas reservoirs of China are characterized by poor physical properties, low permeability, complex pore structure, and strong heterogeneity. In particular, for continental unconventional oil and gas reservoirs, the scope of the sedimentary basin is generally small, and the sedimentary filling is more easily controlled by basin-mountain coupling and sediment sources. As a result, the entire process of sedimentation, diagenesis, hydrocarbon generation, reservoir formation, and hydrocarbon accumulation exhibits strong heterogeneity, with significant changes in terrigenous clast content, high clay content, and low matrix permeability. Therefore, the reservoir rock mass exhibits a thin interbedded structure, with fast lithological changes and complex stress field distribution. In the current multi-stage hydro-fracturing technology for the horizontal well, the depth of the reservoir penetrated by multi-stage perforation is limited, which results in short initial fractures, and leads to a strong sensitivity to the difference of geomechanical parameters. Due to the influence of the strong heterogeneity in the section, it is difficult for each perforation cluster to expand uniformly, resulting in a small affected range of hydro-fracturing.

SUMMARY

An objective of the present disclosure is to provide a multi-stage perforation and shock wave combined device and method for initial fracture enhancement. The present disclosure solves the problem that due to the limited penetrated depth of a reservoir by multi-stage perforation, hydro-fracturing has a strong sensitivity to the difference of geomechanical parameters, making it hard for a perforation cluster to expand uniformly, thereby resulting in a small affected range of hydro-fracturing.

To solve the above technical problem, the present disclosure provides the following technical solutions.

The multi-stage perforation and shock wave combined device for initial fracture enhancement includes a perforating gun and a shock wave excitation nipple, where the perforating gun is configured to fire perforating bullets into a formation to form initial fractures; the shock wave excitation nipple is connected to the perforating gun, and includes an energetic rod capable of exploding after excitation and a feeding assembly; the feeding assembly includes a pushing head butted against the energetic rod, a reciprocating spring located at one end of the pushing head away from the energetic rod, and a feeding spring configured to convey a spare energetic rod to one end of the pushing head away from the reciprocating spring; the feeding spring is configured to push the spare energetic rod along a vortex direction to the one end of the pushing head away from the reciprocating spring after the energetic rod explodes; and the reciprocating spring is configured to push the pushing head, so as to push the spare energetic rod into a target position.

Further, the feeding assembly includes a feeding housing; the feeding housing is provided with a vortex groove; a center of the feeding housing serves as an endpoint of the vortex groove; the pushing head is provided at the endpoint of the vortex groove; at least one spare energetic rod is accommodated in the vortex groove; and the feeding spring is configured to push the spare energetic rod to move towards the endpoint of the vortex groove.

Further, the feeding assembly includes a first state and a second state; in the first state, the pushing head is butted against the energetic rod located at the target position, and the spare energetic rod is butted against a sidewall of the reciprocating spring; and in the second state, the energetic rod located at the target position is excited to explode; the pushing head compresses the reciprocating spring under the action of a shock wave generated by the explosion; the feeding spring pushes the spare energetic rod to the endpoint of the vortex groove and the one end of the pushing head away from the reciprocating spring; and the reciprocating spring pushes the pushing head, such that the pushing head pushes the spare energetic rod into the target position, thereby restoring the first state.

Further, the shock wave excitation nipple further includes a shock window; the shock window is connected to an upper end of the feeding housing; the target position is located in an internal chamber of the shock window; and the shock window includes a bottom provided with a circular through-hole for the energetic rod to pass through and a sidewall provided with a window.

Further, the feeding housing is provided with a countersunk circular hole; the countersunk circular hole is provided therein with a circular arc plate and a straight baffle; the straight baffle includes one end connected to the circular arc plate and the other end connected to a sidewall of the countersunk circular hole; the circular arc plate, the straight baffle, and the sidewall of the countersunk circular hole encloses the vortex groove; the straight baffle serves as a start point of the vortex groove; and the feeding spring includes one end butted against the straight baffle and the other end butted against the spare energetic rod.

Further, the feeding housing is provided with a deep hole coaxial with the countersunk circular hole; the reciprocating spring is accommodated in the deep hole; and the pushing head has a diameter less than a diameter of the deep hole. the shock window includes a base plate and at least two side plates; the side plates are perpendicularly connected to the base plate; each two adjacent side plates and the base plate enclose the window in a U shape; and the base plate is provided with the circular through-hole.

Further, the shock wave excitation nipple further includes an ejector pin; and the ejector pin is butted against one end of the energetic rod away from the pushing head.

Further, the shock wave excitation nipple further includes an energy storage device; the energy storage device is communicated with the energetic rod, and is configured to store electrical energy and supply power to the energetic rod to excite the energetic rod.

Another aspect of the present disclosure provides a multi-stage perforation and shock wave combined method for initial fracture enhancement, based on the multi-stage perforation and shock wave combined device for initial fracture enhancement, and including the following steps:

S1: connecting the multi-stage perforation and shock wave combined device for initial fracture enhancement to form a tool string, and recording various data of the tool string when the tool string enters a wellbore of a horizontal well;

S2: lowering a cable to lower the tool string in the wellbore; and recording an initial position and a tension change of the cable, where in a straight section of the horizontal well, a speed of lowering the cable is ≤4,500 m/h;

S3: lowering the cable to an inclined section of the horizontal well, and starting a pumping operation; hydraulically pumping the tool string to a first preset depth; and controlling, when pumping in a horizontal section, the tension of the cable below 15 kN and a speed of moving the tool string within 100 m/min;

S4: stopping hydraulic pumping after the tool spring reaches the first preset depth, and slowly lifting the cable to a second preset depth, with a lifting speed ≤4,500 m/h; igniting a bridge plug for setting, after the tool string reaches the second preset depth; determining whether the bridge plug is successfully released by observing a decrease in the tension of the cable; examining a sealing effect of the bridge plug if the bridge plug is successfully released; and determining that the sealing effect is qualified if a pressure drop is less than 0.5 MPa after stabilizing for 10 min;

S5: lifting the cable until the perforating gun reaches a first perforation cluster section; and firing the perforating gun to create a first cluster of perforations, so as to form initial fractures;

S6: lifting, after the first cluster of perforations is created, the cable until the shock wave excitation nipple reaches the first cluster perforation section; and exciting, by the shock wave excitation nipple, the energetic rod to explode, so as to generate a shock wave for enhancing the initial fractures;

S7: repeating steps S5 and S6 to complete the perforation and shock wave combined operation for initial fracture enhancement for each subsequent cluster;

S8: lifting the cable to pull the tool string out of the wellbore, where a speed of lifting is controlled to not exceed 6,000 m/h; and S9: repeating steps S1 to S8 to complete the multi-stage perforation and shock wave combined operation for initial fracture enhancement for each subsequent section of the horizontal well.

Based on the above technical solutions, the present disclosure achieves the following technical effects.

In the present disclosure, the multi-stage perforation and shock wave combined device for initial fracture enhancement includes a perforating gun and a shock wave excitation nipple, where the perforating gun is configured to fire perforating bullets into a formation to form initial fractures; the shock wave excitation nipple is connected to the perforating gun, and includes an energetic rod capable of exploding after excitation and a feeding assembly; the feeding assembly includes a pushing head butted against the energetic rod, a reciprocating spring located at one end of the pushing head away from the energetic rod, and a feeding spring configured to convey a spare energetic rod to one end of the pushing head away from the reciprocating spring; the feeding spring is configured to push the spare energetic rod along a vortex direction to the one end of the pushing head away from the reciprocating spring after the energetic rod explodes; and the reciprocating spring is configured to push the pushing head, so as to push the spare energetic rod into a target position.

In the multi-stage perforation and shock wave combined device for initial fracture enhancement provided by the present disclosure, firstly, the perforating gun fires the perforating bullet into the formation to form the initial fracture. Subsequently, the shock wave excitation nipple causes an explosion, further increasing the length of the initial fractures. According to the principle of hydro-fracturing, a longer initial fracture indicates a smaller sensitivity to the difference of geomechanical parameters, promoting the fracture expansion of hydro-fracturing and extending the affected range of hydro-fracturing.

Meanwhile, the feeding assembly supplements the energetic rod to conduct multiple explosions at the same location, further increasing the length of the initial fractures. The design further reduces the sensitivity of hydro-fracturing to the difference of geomechanical parameters, such that the threshold for expansion of each fracture cluster is close. This reduces the heterogeneity in the section, promoting the uniform expansion of fractures during hydro-fracturing and extending the affected range of hydro-fracturing.

Furthermore, because the energy of the energetic rod is controllable, the total shock energy on the formation tends to be consistent under multiple energy-controllable shocks. This design improves the length uniformity of each initial fracture, promotes the uniform expansion of the fracture, and extends the affected range of hydro-fracturing.

In addition, the feeding assembly compresses the reciprocating spring with the shock wave generated by the explosion of the energetic rod to cause the reciprocating spring to move. In this way, the reciprocating spring feeds the spare energetic rod into the target position. The design simplifies the structure of the feeding assembly and improves the stability of the feeding assembly. It ensures a stable and reliable supplement of the energetic rod, avoiding the failure of a complex mechanism in a complex underground environment and under the influence of shock waves.

BRIEF DESCRIPTION OF THE DRAWINGS

To describe the technical solutions in the specific implementations of the present disclosure or the prior art more clearly, the accompanying drawings required for describing the specific implementations or the prior art are briefly described below. Apparently, the accompanying drawings in the following description show merely some implementations of the present disclosure, and a person of ordinary skill in the art may still derive other accompanying drawings from these accompanying drawings without creative efforts.

Figure 1:
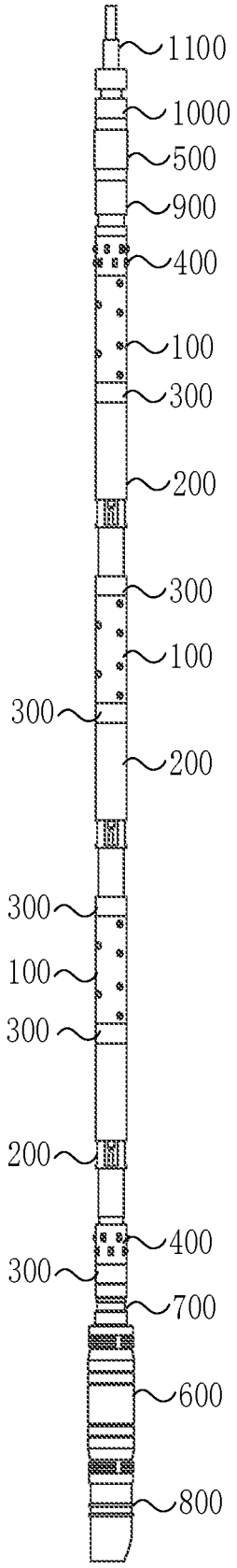
FIG. 1 is a schematic diagram of a multi-stage perforation and shock wave combined device for initial fracture enhancement according to an embodiment of the present disclosure.

Reference Numerals: 100. perforating gun; 200. shock wave excitation nipple; 300. selective nipple; 400. roller centralizer; 500. magnetic positioner; 600. bridge plug; 700. bridge plug setting nipple; 800. pumping ring; 900. shock absorber; 1000. downhole tension gauge; 1100. cable connector; 210. high-voltage direct-current (DC) power supply; 220. energy storage device; 230. controller; 240. ejector pin; 250. energetic rod; 260. shock window; 270. shock housing; 280. feeding assembly; 261. base plate; 262. side plate; 263. circular through-hole; 264. window; 281. pushing head; 282. feeding spring; 283. reciprocating spring; 284. feeding housing; a. vortex groove; b. deep hole; c. circular arc plate; and d. straight baffle.

DETAILED DESCRIPTION OF THE EMBODIMENTS

In order to make the objectives, technical solutions, and advantages of the embodiments of the present disclosure clearer, the technical solutions in the embodiments of the present disclosure will be clearly and completely described below in conjunction with the accompanying drawings in the embodiments of the present disclosure. Apparently, the described embodiments are some, rather than all of the embodiments of the present disclosure. Generally, components of the embodiments of the present disclosure described and shown in the accompanying drawings may be arranged and designed in various manners.

Therefore, the following detailed description of the embodiments of the present disclosure in the accompanying drawings is not intended to limit the protection scope of the present disclosure, but merely indicates selected embodiments of the present disclosure. All other embodiments obtained by those of ordinary skill in the art based on the embodiments of the present disclosure without creative efforts should fall within the protection scope of the present disclosure.

The following describes in detail some implementations of the present disclosure with reference to the accompanying drawings. If no conflict occurs, the following embodiments and features of the embodiments may be combined with each other.

In the current multi-stage hydro-fracturing technology, the depth of the reservoir penetrated by multi-stage perforation is limited, which results in short initial fractures, leading to a strong sensitivity to the difference of geomechanical parameters. Due to the influence of the strong heterogeneity in the section, it is hard for each perforation cluster to expand uniformly, resulting in a small affected range of hydro-fracturing.

In view of this, the present disclosure provides a multi-stage perforation and shock wave combined device for initial fracture enhancement. The multi-stage perforation and shock wave combined device for initial fracture enhancement includes perforating guns 100 and shock wave excitation nipples 200. The perforating guns 100 each are configured to fire perforating bullets into a formation to form initial fractures. The shock wave excitation nipples 200 are respectively connected to the perforating guns 100, and each include energetic rod 250 capable of exploding after excitation and feeding assembly 280. The feeding assembly 280 includes pushing head 281 butted against the energetic rod 250, reciprocating spring 283 located at one end of the pushing head 281 away from the energetic rod 250, and feeding spring 282 configured to convey spare energetic rod 250 to one end of the pushing head 281 away from the reciprocating spring 283. The feeding spring 282 is configured to push the spare energetic rod 250 along a vortex direction to the one end of the pushing head 281 away from the reciprocating spring 283 after the energetic rod 250 explodes. The reciprocating spring 283 is configured to push the pushing head 281, so as to push the spare energetic rod 250 into a target position.

In the multi-stage perforation and shock wave combined device for initial fracture enhancement provided by the present disclosure, firstly, the perforating gun 100 fires the perforating bullet into the formation to form the initial fracture. Subsequently, the shock wave excitation nipple 200 causes an explosion, further increasing the length of the initial fractures. According to the principle of hydro-fracturing, a longer initial fracture indicates a smaller sensitivity to the difference of geomechanical parameters, promoting the fracture expansion of hydro-fracturing and extending the affected range of hydro-fracturing.

Meanwhile, the feeding assembly 280 supplements the energetic rod 250 to conduct multiple explosions at the same location, further increasing the length of the initial fractures. The design further reduces the sensitivity of hydro-fracturing to the difference of geomechanical parameters, such that the threshold for expansion of each fracture cluster is close. This reduces the heterogeneity in the section, promoting the uniform expansion of fractures during hydro-fracturing and extending the affected range of hydro-fracturing.

Furthermore, because the energy of the energetic rod 250 is controllable, the total shock energy on the formation tends to be consistent under multiple energy-controllable shocks. This design improves the length uniformity of each initial fracture, promotes the uniform expansion of the fracture, and extends the affected range of hydro-fracturing.

In addition, the feeding assembly 280 compresses the reciprocating spring 283 with the shock wave generated by the explosion of the energetic rod 250 to cause the reciprocating spring 283 to move. In this way, the reciprocating spring 283 feeds the spare energetic rod 250 into the target position. The design simplifies the structure of the feeding assembly 280 and improves the stability of the feeding assembly 280. It ensures a stable and reliable supplement of the energetic rod 250, avoiding the failure of a complex mechanism in a complex underground environment and under the influence of shock waves.

The structure and shape of the multi-stage perforation and shock wave combined device for initial fracture enhancement provided by the embodiment are described in detail below with reference to FIGS. 1 to 9.

In this embodiment, the multi-stage perforation and shock wave combined device for initial fracture enhancement includes cable connector 1100, downhole tension gauge 1000, magnetic positioner 500, shock absorber 900, roller centralizers 400, the perforating guns 100, selective nipples 300, the shock wave excitation nipples 200, bridge plug setting nipple 700, bridge plug 600, and pumping ring 800, as shown in FIG. 1. Each perforating gun 100 and each shock wave excitation nipple 200 are connected to the selective nipple 300.

In this embodiment, the cable connector 1100 is configured to connect a cable. The downhole tension gauge 1000 is connected to a lower side of the cable connector 1100 and configured to detect a cable tension. The magnetic positioner 500 is connected to a lower side of the downhole tension gauge and cooperates with a casing coupling to determine positions of the selective nipple 300 and the shock wave excitation nipple 200. The shock absorber 900 is connected to a lower side of the magnetic positioner 500 and configured to cushion a shock on the cable.

The roller centralizer 400 is connected to a lower side of the shock absorber 900 and configured to ensure that the multi-stage perforation and shock wave combined device for initial fracture enhancement is coaxial with and moves along a casing, reducing a resistance through rolling friction. At least one perforation unit is connected to a lower side of the roller centralizer 400. The perforation unit includes the perforating gun 100, the selective nipple 300, the shock wave excitation nipple 200, and the selective nipple 300 that are sequentially connected, and is configured to complete an initial fracture enhancement operation. A lower side of the perforation unit is connected to another roller centralizer 400 that is matched with the upper roller centralizer 400 to ensure that the multi-stage perforation and shock wave combined device for initial fracture enhancement is coaxial with the casing. In this embodiment, to ensure the reasonable positions of the roller centralizers 400, the lower roller centralizer 400 is provided between the shock wave excitation nipple 200 and the selective nipple 300 of a last perforation unit. A lower side of this selective nipple 300 is sequentially connected to the bridge plug setting nipple 700, the bridge plug 600, and the pumping ring 800. The pumping ring 800 is configured to drive other components to move under hydraulic propulsion.

In this embodiment, the perforating gun 100 is configured to fire the perforating bullets into the formation to form the initial fractures, and the shock wave excitation nipple 200 is configured to enhance the initial fractures.

Figure 2:
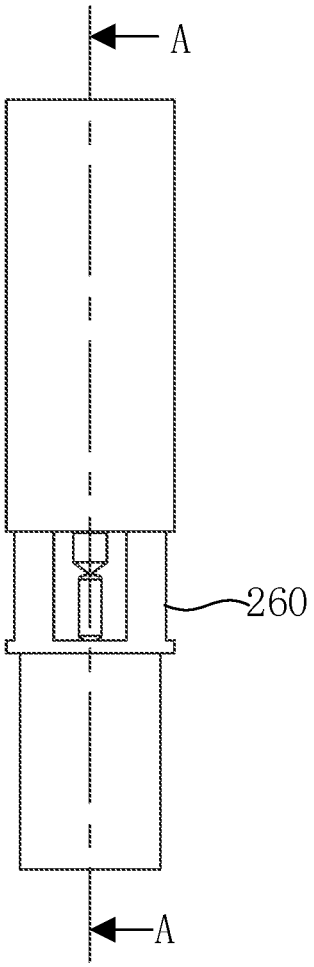
FIG. 2 is a schematic diagram of a shock wave excitation nipple.
Figure 3:
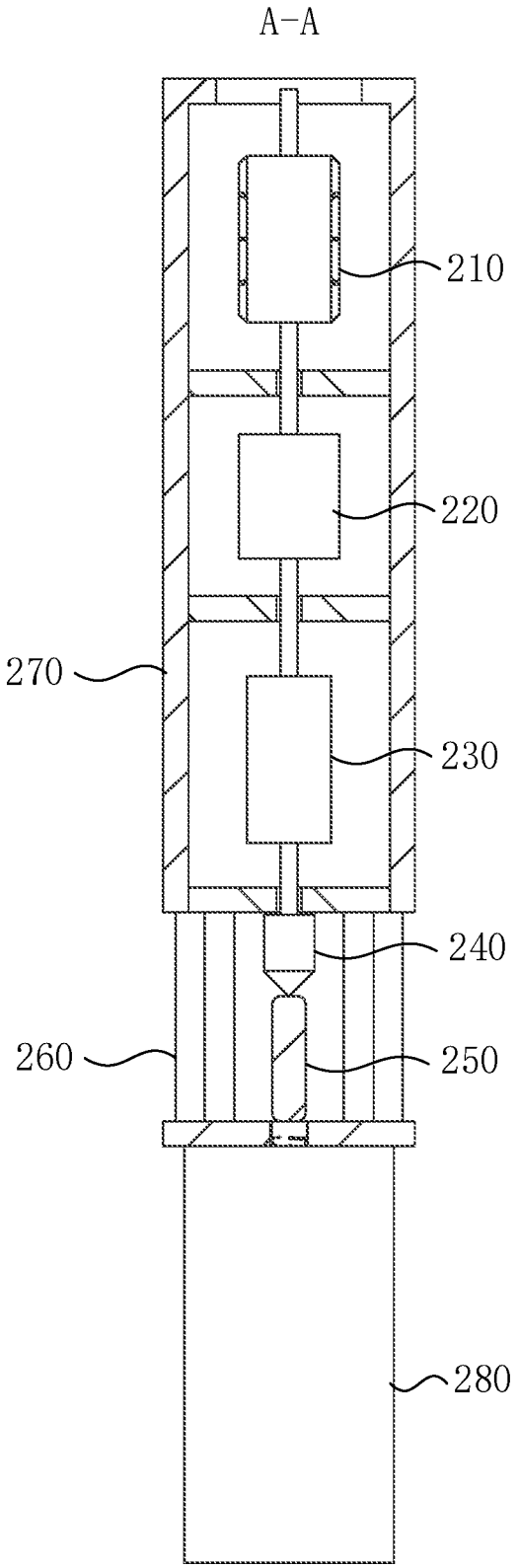
FIG. 3 is a section view taken along line A-A shown in FIG. 2.

Specifically, as shown in FIGS. 2 and 3, the shock wave excitation nipple 200 includes high-voltage direct-current (DC) power supply 210, energy storage device 220, controller 230, ejector pin 240, the energetic rod 250, shock window 260, and shock housing 270. The high-voltage DC power supply 210, the energy storage device 220, the controller 230, and the ejector pin 240 are connected in sequence. The ejector pin 240 is connected to an upper end of the energetic rod 250. The high-voltage DC power supply 210, the energy storage device 220, and the controller 230 are all provided inside the shock housing 270. The shock window 260 is connected to a lower side of the shock housing 270 to accommodate the energetic rod 250.

The high-voltage DC power supply 210 is configured to convert an alternating current (AC) into a DC and charge the energy storage device 220. The energy storage device 220 is configured to store electrical energy and supply power to the energetic rod 250, so as to excite the energetic rod 250 to explode through a large current. The controller 230 is configured to control the on-off of a circuit, so as to control the energy storage device 220 to supply power to the energetic rod 250 or not.

The energetic rod 250 includes a metal wire and an energetic material. The energetic material is wrapped around the metal wire. When the metal wire is electrically exploded, it a plasma, shock waves and strong electromagnetic radiation, which cause a chemical bond of the energetic material to break, so as to release energy. Electric energy and chemical energy are converted into shock waves for reservoir fracturing, so as to increase the length of the initial fractures.

Figure 4:
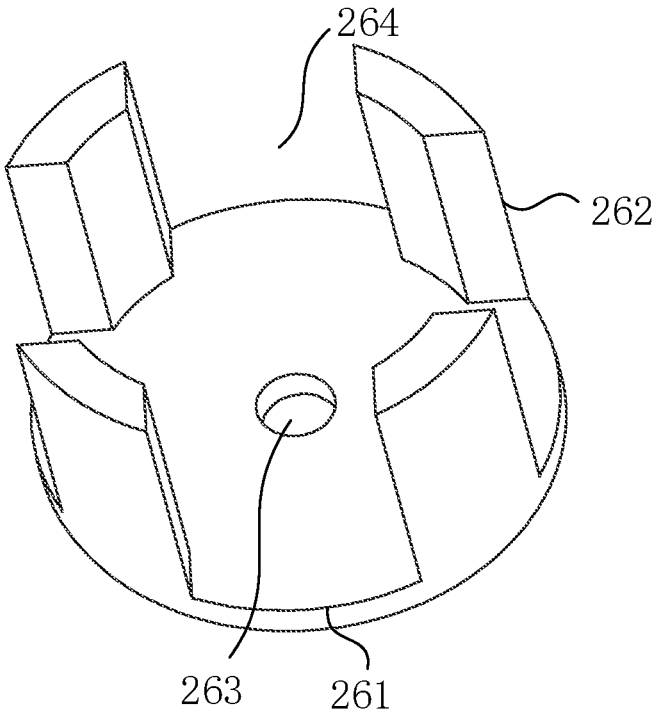
FIG. 4 is a structural diagram of a shock window.

The shock window 260 includes base plate 261 and multiple side plates 262, as shown in FIG. 4. A lower end of each of the side plates 262 is connected to an upper surface of the base plate 261. The multiple side plates 262 are spaced, and window 264 is formed between each two adjacent side plates 262, through which the shock wave is released outward.

Figure 5:
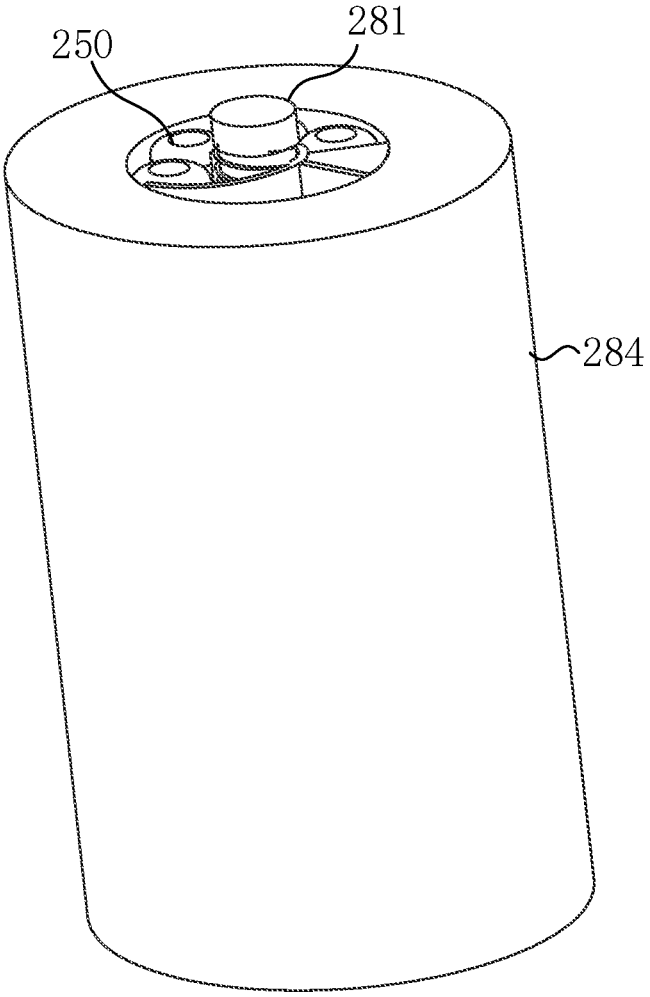
FIG. 5 is a structural diagram of a feeding assembly.
Figure 7:
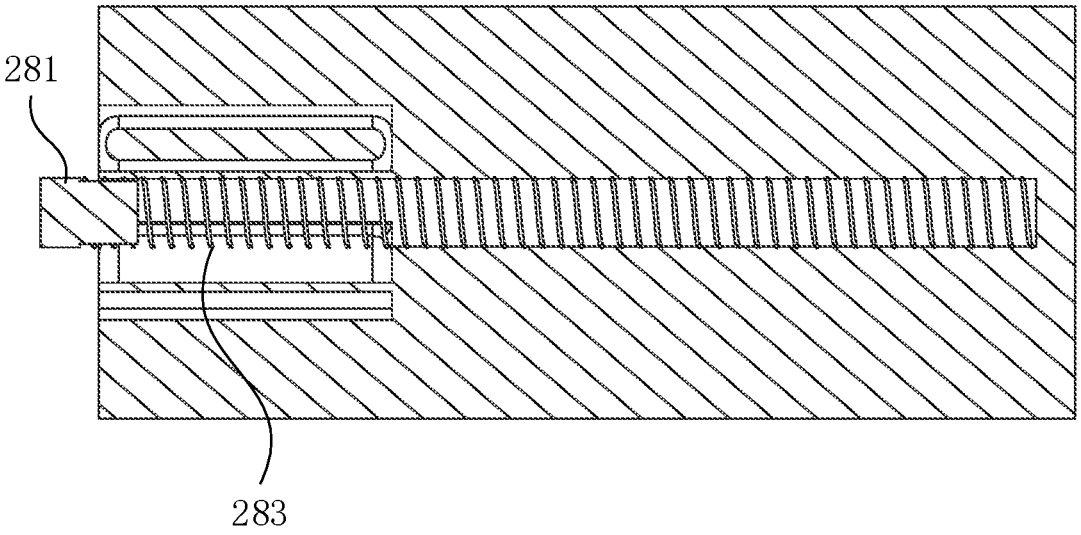
FIG. 7 is a section view taken along line B-B shown in FIG. 6.
Figure 8:
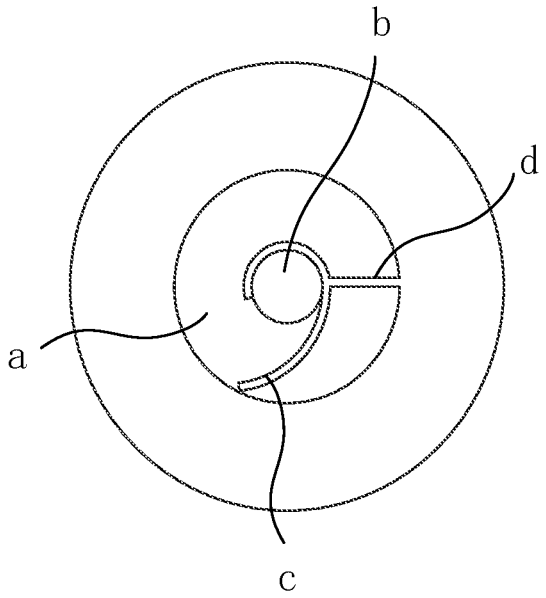
FIG. 8 is a top view of a feeding housing.
Figure 9:
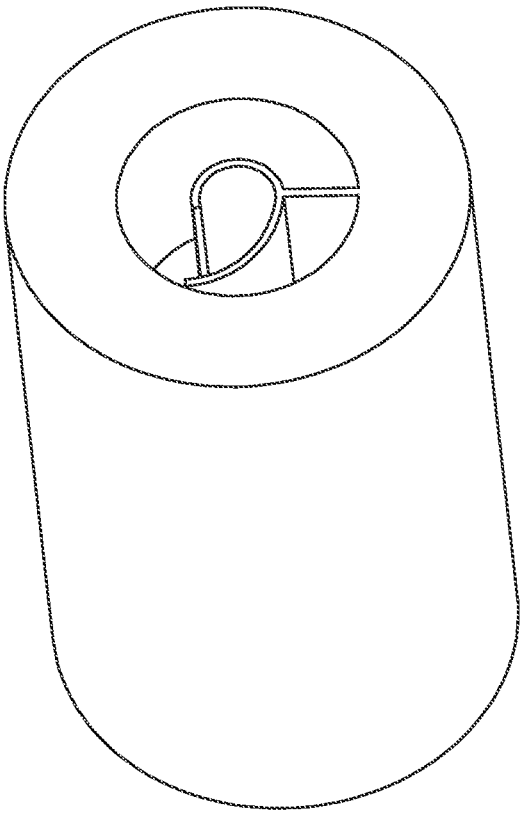
FIG. 9 is a structural diagram of the feeding housing.

In this embodiment, in order to achieve multiple explosive shocks, the feeding assembly 280 is further provided below the shock window 260, as shown in FIGS. 3 and 5. The feeding assembly 280 includes the pushing head 281, the feeding spring 282, the reciprocating spring 283, and the feeding housing 284. As shown in FIGS. 7, 8, and 9, the feeding housing 284 is a cylindrical housing with a countersunk circular hole on an upper part. A sidewall of the countersunk circular hole, circular arc plate c, and straight baffle d enclose vortex groove a. The energetic rod 250 is accommodated in the vortex groove a. The feeding spring 282 is provided between the straight baffle d and the energetic rod 250 to apply a thrust to the energetic rod 250 so as to push the energetic rod to move along the vortex groove a and reach a center of the feeding housing 284. The feeding spring 282 can be a sector spring.

Figure 6:
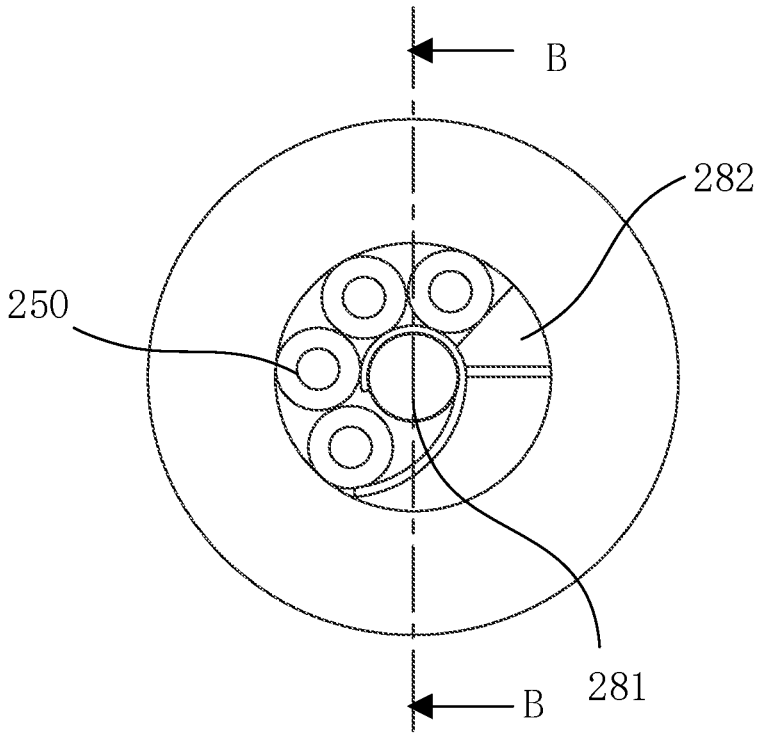
FIG. 6 is a top view of the feeding assembly.

The center of the feeding housing 284 is provided with deep hole b. The deep hole b is configured to accommodate the reciprocating spring 283, as shown in FIGS. 5, 6, and 7. The pushing head 281 is connected to an upper end of the reciprocating spring 283 and configured to push the energetic rod 250 upwards. Specifically, the reciprocating spring 283 is a compression spring that provides an upward thrust to the pushing head 281.

Correspondingly, a bottom of the shock window 260 is provided with circular through-hole 263 for the energetic rod 250 to pass through.

A working process of the feeding assembly 280 is as follows. After the energetic rod 250 located inside the shock window 260 explodes, the pushing head 281 is moved downwards and compresses the reciprocating spring 283 under the action of the explosion shock wave. Under the pushing action of the feeding spring 282, the energetic rod 250 is moved to the upper side of the pushing head 281 and is butted against the circular arc plate c. Subsequently, the reciprocating spring 283 is reset and pushes the pushing head 281 upwards, causing the energetic rod 250 to move upwards and enter the shock window 260. The energetic rod is fixed under the compression of the ejector pin 240 and the pushing head 281.

Through the feeding assembly 280, multiple shocks can be made on the same perforation position. The design fully increases the length of the initial fractures, reduces the sensitivity of hydro-fracturing to the difference of geomechanical parameters, such that the threshold for expansion of each fracture cluster is close. This reduces the heterogeneity in the section, extending the affected range of hydro-fracturing.

Because the energy of the energetic rod 250 is controllable, the total shock energy on the formation tends to be consistent through multiple shocks. This design improves the length uniformity of each initial fracture, promotes the uniform expansion of the fracture, and extends the affected range of hydro-fracturing.

The shock wave generated by the explosion of the energetic rod 250 causes the reciprocating spring 283 to move. The design simplifies the structure of the feeding assembly 280 and improves the stability of the feeding assembly 280. It ensures a stable and reliable supplement of the energetic rod 250, avoiding the failure of a complex mechanism in a complex underground environment and under the influence of shock waves.

In an optional solution of this embodiment, due to the configuration of the feeding assembly 280, only one shock wave excitation nipple 200 can be provided. This design can shorten the length of the multi-stage perforation and shock wave combined device for initial fracture enhancement, but it will increase the movement distance during operation, requiring repeated movement up and down during perforation.

In this embodiment, shock waves with controllable amplitude and impulse, controllable action area, and controllable repetition number can be generated by changing the formula of the energetic material, changing the window 264 of the shock wave window, and controlling the number of shock wave excitations, thereby improving the control of the initial fractures.

Based on the multi-stage perforation and shock wave combined device for initial fracture enhancement provided in this embodiment, a multi-stage perforation and shock wave combined method for initial fracture enhancement is provided, including the following steps.

S1. The multi-stage perforation and shock wave combined device for initial fracture enhancement is connected to form a tool string, and various data of the tool string are recorded when the tool string enters a wellbore of a horizontal well.

S2. The cable is lowered to lower the tool string in the wellbore. An initial position and a tension change of the cable are recorded. In a straight section of the horizontal well, a speed of lowering the cable is ≤4,500 m/h.

S3. The cable is lowered to an inclined section of the horizontal well, and a pumping operation is started. The tool string is hydraulically pumped to a first preset depth. When pumping is conducted in a horizontal section, the tension of the cable is controlled below 15 kN, and a speed of moving the tool string is controlled within 100 m/min.

S4. After the tool string reaches the first preset depth, hydraulic pumping is stopped, and the cable is slowly lifted to a second preset depth, with a lifting speed ≤4,500 m/h. After the tool string is lifted to the second preset depth, the bridge plug 600 is ignited for setting. It is determined whether the bridge plug 600 is successfully released by observing a decrease in the tension of the cable. If the bridge plug 600 is successfully released, a sealing effect of the bridge plug 600 is examined. If a pressure drop is less than 0.5 MPa after stabilizing for 10 min, the sealing effect is qualified.

S5. The cable is lifted until the perforating gun 100 reaches a first perforation cluster section. The selective nipple 300 is ignited, and the perforating gun 100 fires for a first cluster of perforations. Real-time depth calibration is conducted during a lifting process.

S6. After the first cluster of perforations is completed, the cable is lifted until the shock wave excitation nipple 200 reaches the first cluster perforation section. The selective nipple 300 is ignited, and the shock wave excitation nipple 200 excites to generate a shock wave for enhancing initial fractures formed by the perforation.

S7. Steps S5 and S6 are repeated to complete the perforation and shock wave combined operation for initial fracture enhancement for each subsequent cluster.

S8. The cable is lifted, and the tool string is pulled out of a wellbore. A speed of lifting is controlled to not exceed 6,000 m/h.

S9. Steps S1 to S8 are repeated to complete the multi-stage perforation and shock wave combined operation for initial fracture enhancement for each subsequent section of the horizontal well.

The present disclosure fractures the reservoir through a high-strain-rate dynamic method with controllable shock waves based on multi-stage perforation in sections of the horizontal well. The present disclosure increases the length of the initial fractures and reduces the sensitivity of hydro-fracturing expansion to the geomechanical conditions of the reservoir. In this way, the present disclosure achieves uniform expansion of hydraulic fractures in various perforation clusters within the section, and fully transforms the target reservoir, improving the comprehensive development efficiency of a single well.

Finally, it should be noted that the above embodiments are merely intended to describe the technical solutions of the present disclosure, rather than to limit the present disclosure. Although the present disclosure is described in detail with reference to the above embodiments, persons of ordinary skill in the art should understand that they may still make modifications to the technical solutions described in the above embodiments or make equivalent replacements to some or all technical features thereof, without departing from the essence of the technical solutions in the embodiments of the present disclosure.

What is claimed is:

1. A multi-stage perforation and shock wave combined device for an initial fracture enhancement, comprising a perforating gun and a shock wave excitation nipple, wherein the perforating gun is configured to fire perforating bullets into a formation to form initial fractures;

the shock wave excitation nipple is connected to the perforating gun, and comprises an energetic rod allowed for exploding after excitation and a feeding assembly;

the feeding assembly comprises a pushing head butted against the energetic rod, a reciprocating spring located at one end of the pushing head away from the energetic rod, and a feeding spring configured to convey a spare energetic rod to one end of the pushing head away from the reciprocating spring; the feeding spring is configured to push the spare energetic rod along a vortex direction to the one end of the pushing head away from the reciprocating spring after the energetic rod explodes; and the reciprocating spring is configured to push the pushing head to push the spare energetic rod into a target position;

the feeding assembly further comprises a feeding housing;

the feeding housing is provided with a vortex groove; a center of the feeding housing serves as an endpoint of the vortex groove; and the pushing head is provided at the endpoint of the vortex groove;

at least one spare energetic rod is accommodated in the vortex groove; and the feeding spring is configured to push the spare energetic rod to move towards the endpoint of the vortex groove;

the feeding assembly comprises a first state and a second state;

in the first state, the pushing head is butted against the energetic rod located at the target position, and the spare energetic rod is butted against a sidewall of the reciprocating spring; and in the second state, the energetic rod located at the target position is excited to explode; the pushing head compresses the reciprocating spring under an action of a shock wave generated by the explosion; the feeding spring pushes the spare energetic rod to the endpoint of the vortex groove and the one end of the pushing head away from the reciprocating spring; and the reciprocating spring pushes the pushing head, wherein the pushing head pushes the spare energetic rod into the target position, wherein the first state is restored.

2. The multi-stage perforation and shock wave combined device according to claim 1, wherein the shock wave excitation nipple further comprises a shock window;

the shock window is connected to an upper end of the feeding housing; and the target position is located in an internal chamber of the shock window; and the shock window comprises a bottom provided with a circular through-hole for the energetic rod to pass through and a sidewall provided with a window.

3. The multi-stage perforation and shock wave combined device according to claim 2, wherein the feeding housing is provided with a countersunk circular hole; and the countersunk circular hole is provided therein with a circular arc plate and a straight baffle;

the straight baffle comprises a first end connected to the circular arc plate and a second end connected to a sidewall of the countersunk circular hole; the circular arc plate, the straight baffle, and the sidewall of the countersunk circular hole encloses the vortex groove; and the straight baffle serves as a start point of the vortex groove; and the feeding spring comprises a first end butted against the straight baffle and a second end butted against the spare energetic rod.

4. The multi-stage perforation and shock wave combined device according to claim 3, wherein the feeding housing is provided with a deep hole coaxial with the countersunk circular hole; and the reciprocating spring is accommodated in the deep hole; and the pushing head has a diameter less than a diameter of the deep hole.

5. The multi-stage perforation and shock wave combined device according to claim 4, wherein the shock window comprises a base plate and at least two side plates; and the at least two side plates are perpendicularly connected to the base plate; and each two adjacent side plates and the base plate enclose the window in a U shape; and the base plate is provided with the circular through-hole.

6. The multi-stage perforation and shock wave combined device according to claim 5, wherein the shock wave excitation nipple further comprises an ejector pin; and the ejector pin is butted against one end of the energetic rod away from the pushing head.

7. The multi-stage perforation and shock wave combined device according to claim 6, wherein the shock wave excitation nipple further comprises an energy storage device; the energy storage device is communicated with the energetic rod, and is configured to store electrical energy and supply power to the energetic rod to excite the energetic rod.

8. A multi-stage perforation and shock wave combined method for an initial fracture enhancement, comprising the following steps:

S1: connecting the multi-stage perforation and shock wave combined device according to claim 7 to form a tool string, and recording various data of the tool string when the tool string enters a wellbore of a horizontal well;

S2: lowering a cable to lower the tool string in the wellbore; and recording an initial position and a tension change of the cable, wherein in a straight section of the horizontal well, a speed of lowering the cable is ≤4,500 m/h;

S3: lowering the cable to an inclined section of the horizontal well, and starting a pumping operation; hydraulically pumping the tool string to a first preset depth; and controlling, when pumping in a horizontal section, the tension of the cable below 15 kN and a speed of moving the tool string within 100 m/min;

S4: stopping hydraulic pumping after the tool spring reaches the first preset depth, and slowly lifting the cable to a second preset depth, with a lifting speed ≤4,500 m/h; igniting a bridge plug for setting, after the tool string reaches the second preset depth; determining whether the bridge plug is successfully released by observing a decrease in the tension of the cable; examining a sealing effect of the bridge plug if the bridge plug is successfully released; and determining that the sealing effect is qualified if a pressure drop is less than 0.5 MPa after stabilizing for 10 min;

S5: lifting the cable until the perforating gun reaches a first perforation cluster section; and firing the perforating gun to create a first cluster of perforations to form the initial fractures;

S6: lifting, after the first cluster of perforations is created, the cable until the shock wave excitation nipple reaches the first cluster perforation section; and exciting, by the shock wave excitation nipple, the energetic rod to explode to generate a shock wave for enhancing the initial fractures;

S7: repeating steps S5 and S6 to complete a perforation and shock wave combined operation for the initial fracture enhancement for each subsequent cluster;

S8: lifting the cable to pull the tool string out of the wellbore, wherein a speed of lifting is controlled to not exceed 6,000 m/h; and S9: repeating steps S1 to S8 to complete the multi-stage perforation and shock wave combined operation for the initial fracture enhancement for each subsequent section of the horizontal well.

* * * * *